US005984053A

United States Patent [19]

Lee et al.

[11] Patent Number: 5,984,053

[45] Date of Patent: Nov. 16, 1999

[54] GUIDE ROLLER SUPPORTING APPARATUS FOR ELEVATOR CAR

[75] Inventors: Kwang Nam Lee; Kweon Youn Ki; Yong Hun Kim, all of Inchun-Si, Rep. of Korea

[73] Assignee: LG Industrial Systems Co., Ltd., Seoul, Rep. of Korea

[21] Appl. No.: 08/953,433

[22] Filed: Oct. 17, 1997

[30] Foreign Application Priority Data

Oct. 19, 1996 [KR] Rep. of Korea ..... 96-34636
Oct. 6, 1997 [KR] Rep. of Korea ..... 97-51255

[51] Int. Cl.[6] ..... B66B 7/04

[52] U.S. Cl. ..... 187/410; 182/141

[58] Field of Search ..... 187/410, 409; 182/141

[56] References Cited

FOREIGN PATENT DOCUMENTS 1269789 6/1968 Germany ..... 187/410
787386 12/1957 United Kingdom ..... 187/410

*Primary Examiner*—Kenneth W. Noland

[57] ABSTRACT

A guide roller supporting apparatus for an elevator car includes a guide roller supporting apparatus comprising guide rollers making contact with surfaces of a guide rail, respectively, each guide roller being rotatably mounted on an upper end of a carrying member, a lower end of the carrying member being pivotably mounted on a frame secured to a top or a bottom plate of an elevator car; a spring mechanism resiliently urging the guide roller against the corresponding surfaces of the guide rail to absorb a lateral force of an impact transferred through the guide roller; and a support secured to the frame and having a spring seat, whereby the vertical force supports the carrying member, an external impact through the guide rollers is divided into vertical and lateral forces, and the lateral force is absorbed to decrease a shaking of the elevator car.

18 Claims, 13 Drawing Sheets

GUIDE ROLLER SUPPORTING APPARATUS FOR ELEVATOR CAR

BACKGROUND OF THE INVENTION

1. Field of the Invention

This invention relates to a guide roller supporting apparatus provided on the top and bottom of an elevator car for guidance and in particular to a guide roller adapted to decrease the shaking of the car by absorbing lateral displacement forces acting on the car during its up and down movements.

2. Description of the Related Art

Typically, an elevator car is moved up and down while making contact with guide rails provided within a hoistway. These guide rails are subject to displacement and misalignment from an accurate settlement on of the walls of the hoistway caused by a building weight, wind force, and so forth. Furthermore such inaccurate settlement is inevitable because of a non-straightness of the wall of the hoistway.

Such displacement and misalignment of the rail cause the elevator car to be shaken during its up and down movements. The elevator car is increasingly shaken the faster it moves along the rails. Accordingly, guide rollers should have a damping function to decrease the shaking of the elevator car.

FIG. 1 shows a conventional elevator car having two or more guide roller assemblies 54 mounted on the top and bottom of the car, which make contact with guide rails 52. Each of the guide roller assemblies 54 include three rollers contacting with surfaces 52*a*, 52*b* and 52*c* of the guide rail 52(see FIG. 3).

Referring to FIGS. 2 to 4, each of the guide roller supporting apparatuses is mounted on the frame 56 which is secured to the top or bottom of the color. The guide roller supporting apparatus includes a base plate 57 secured to the frame 56 and three brackets 58 mounted on the base plate 57 with a pivotal lever 60 connected at hinge 62 carrying the guide roller 54 mounted for rotation on the bearing axle 64. Three supports 66 are vertically secured to the base plate 57 corresponding to each lever 60, each support having a rod 68 extended through a hole 70 of the lever 60. The rod 68 is provided with a spring 74 between the lever 60 and a stop 72 engaged at the end portion thereof. The spring 74 acts on the lever 60 to resiliently urge the guide roller 58 against the guide rail 52 to support a load transferred to the roller 54. Furthermore, a rod 76 is provided at the support 66 apart from the rod 68, is extended through a hole 78 of the lever 60, and has a stop 80 at an end portion thereof to limit the pivotal movement of the corresponding lever 60 and guide roller 54.

A top plate 82 is secured to the upper ends of the supports 66 and has three dampers 84 in contact with the end of the lever 60 to decrease an oscillation of the lever.

With the conventional guide roller supporting apparatus, when the car 50 moves up and down, each guide roller 54 is subjected to impacts and is pivoted at the hinge 62 because of a misalignment of the rail 52 from its ideal center line. The impacts acting on the guide roller 54 are damped by the spring 74 to decrease the shaking of the car. Furthermore, the excessive pivoting of the guide roller 54 is limited by the stop 80 of the rod 76 to prevent the guide roller from derailing. The dampers 84 also decrease the rebounding of the spring 74.

However, with the conventional guide roller 54, the rod 68 and spring 74 are horizontally provided with the frame 56, whereby the impacts are transferred from the rail 52 through the roller 54 to the elevator car 50. Furthermore, the stop 72 for supporting the spring 74 on the rod 68 is also horizontal to the frame 56, thereby being apt to become loosened.

SUMMARY OF THE INVENTION

Accordingly, it is an object of the invention to provide a reliable guide roller supporting apparatus in which the shaking of an elevator car caused by impacts transferred from a rail to guide rollers is decreased by distributing the impacts in a direction of the car movement and absorbing distributed lateral forces, and which has an improvement in safety of parts.

In order to achieve an aspect of the invention, there is provided a guide roller apparatus which comprises guide rollers contacting with surfaces of a guide rail, respective guide rollers being rotatably mounted on an upper end of a corresponding carrying member, a lower end of the carrying member pivotably and slantedly mounted on a frame which is secured to a top or a bottom plate of an elevator car, and a spring mechanism for resiliently urging the guide roller against the corresponding surface of the rail to absorb lateral force divided from impacts transferred through the guide roller and a support secured to the frame and having a spring seat, the vertical force being supported by the carrying member.

BRIEF DESCRIPTION OF THE DRAWINGS

In order to illustrate the invention, some embodiments thereof are described in more detail below with reference to the accompanying drawings, wherein.

DETAILED DESCRIPTION OF THE PREFERRED EMBODIMENT

Figure 1:
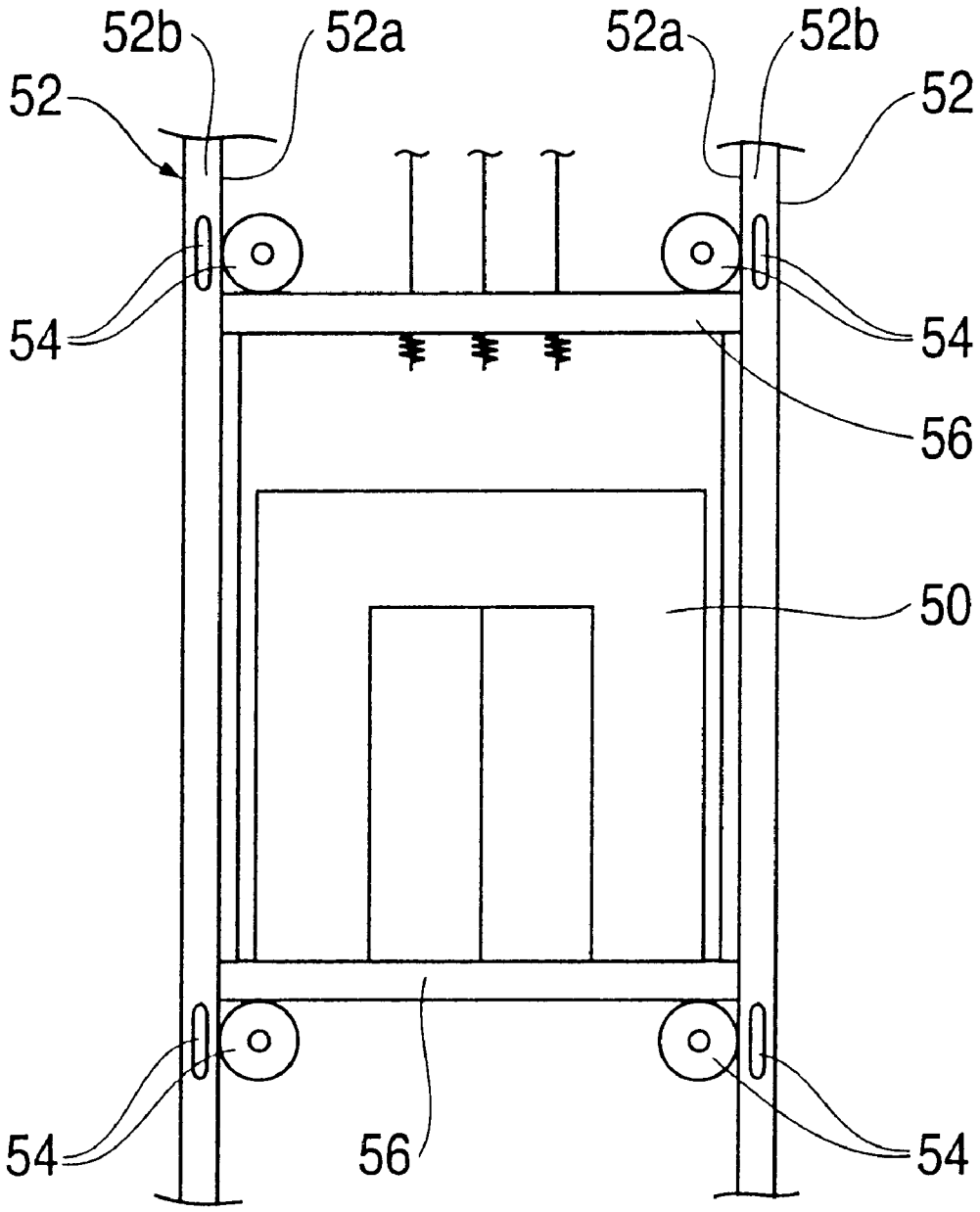
FIG. 1 (PRIOR ART)
FIG. 1 is a front view showing a guide roller assembly mounted on top and bottom plates of a conventional elevator car.
Figure 2:
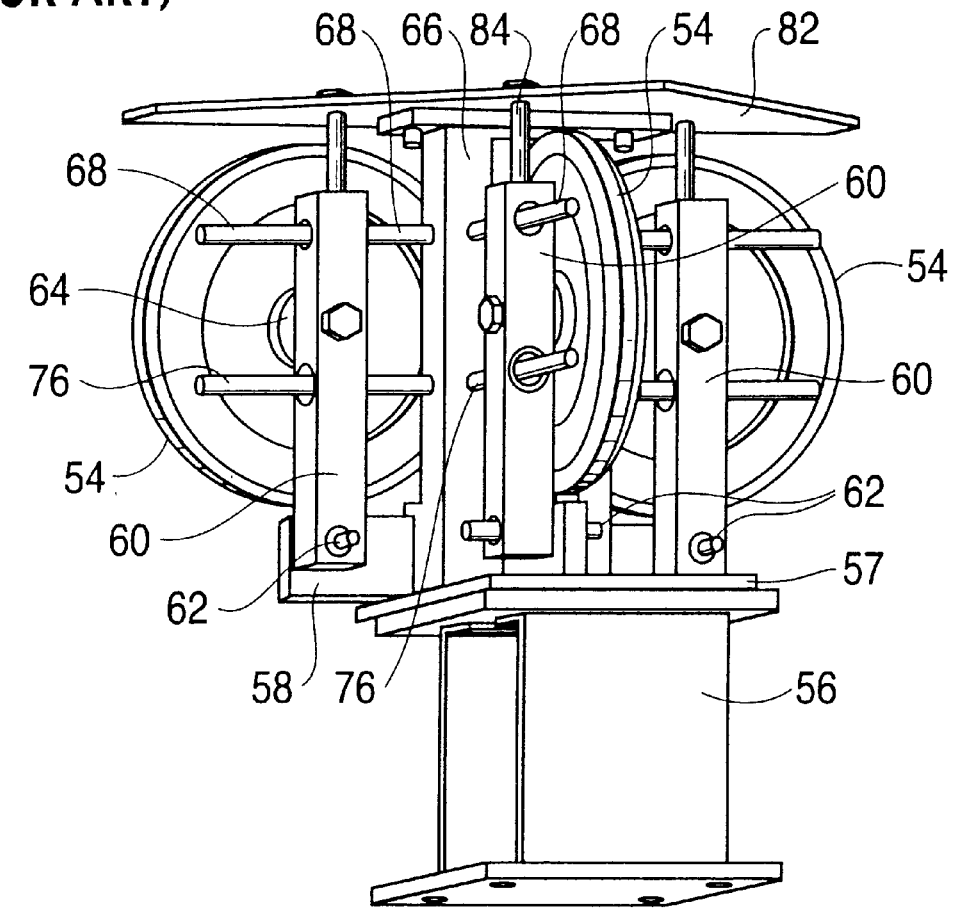
FIG. 2 (PRIOR ART)
FIG. 2 is a perspective view of the guide roller assembly of FIG. 1.
Figure 3:
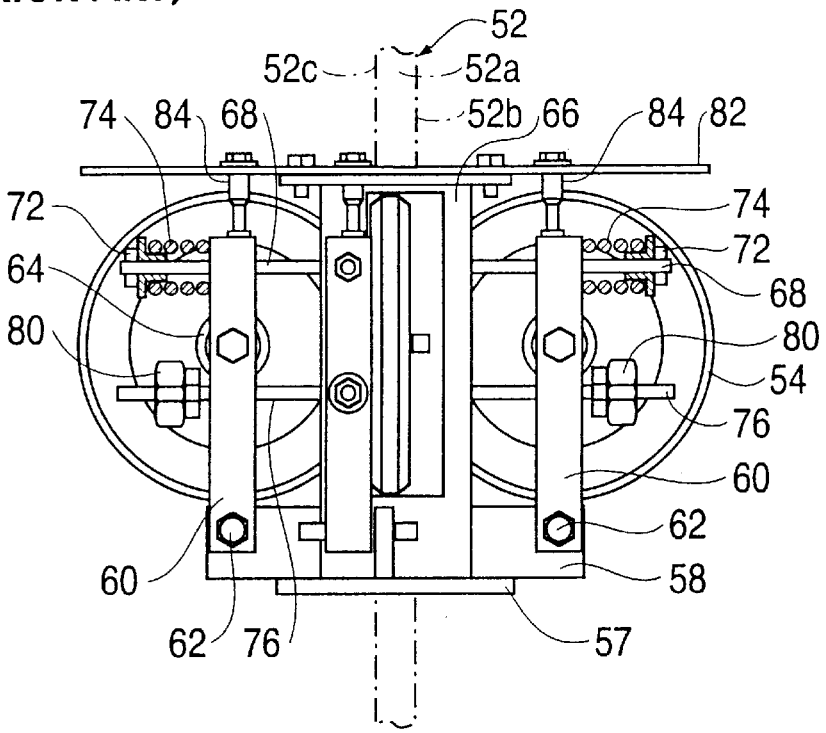
FIG. 3 (PRIOR ART)
FIG. 3 is a front view of the FIG. 2.
Figure 4:
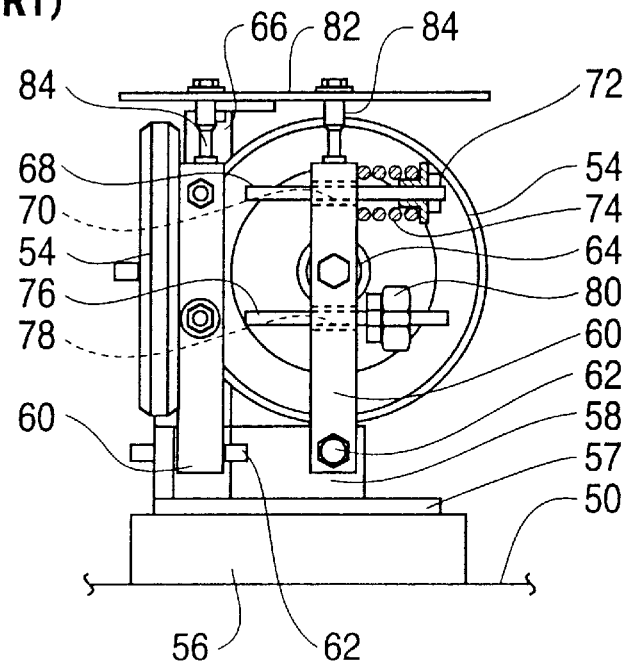
FIG. 4 (PRIOR ART)
FIG. 4 is a side elevational view of the FIG. 3.
Figure 5:
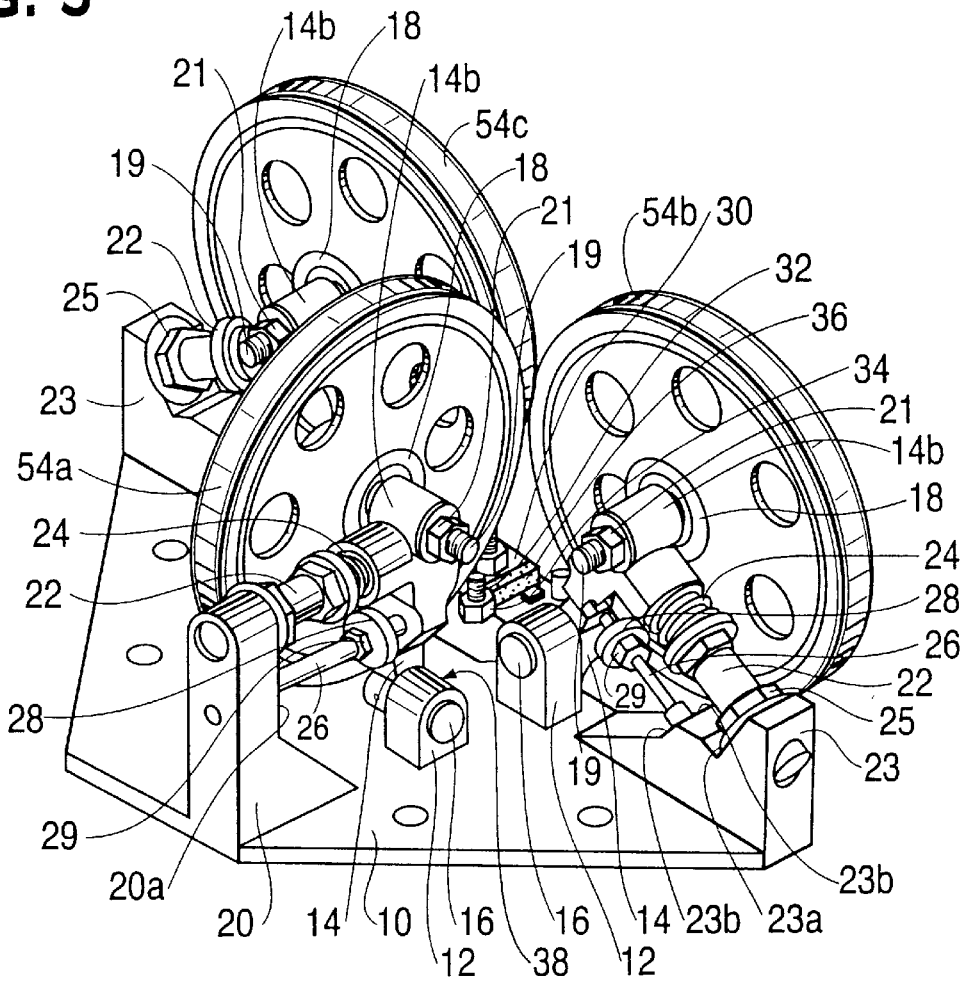
FIG. 5 is a perspective view showing a guide roller supporting apparatus in accordance with the invention.
Figure 6:
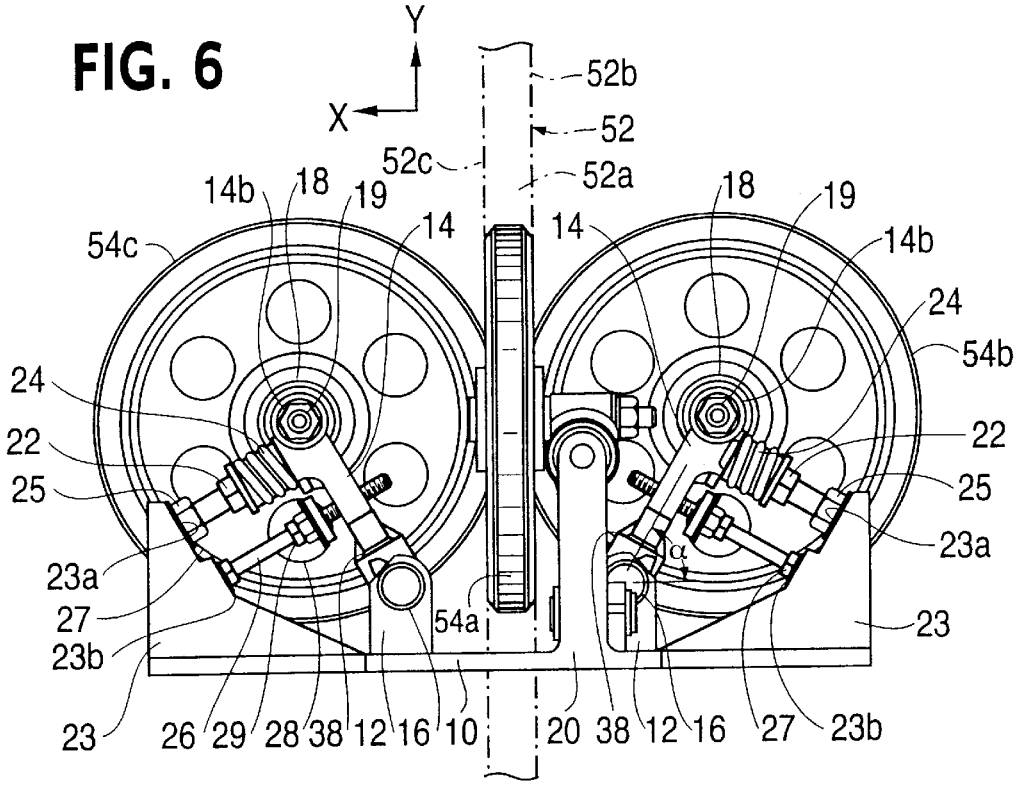
FIG. 6 is a front elevational view of FIG. 5.

Referring to FIGS. 5 to 10, a frame 10 is provided with three guide rollers 54*a*, 54*b* and 54*c*, the respective guide rollers contacting with a front surface 52*a* and side surfaces 52*b* and 52*c* of a guide rail 52. The respective guide rollers 54*a*, 54*b* and 54*c* are rotatably mounted on an axle 19 and a bearing 18 provided on an upper end of a corresponding carrying member 14. Three brackets 12 are provided on the frame 10 corresponding to the guide rollers 54*a*, 54*b* and 54*c*, and each bracket is connected to an upper portion 14*b* of the carrying member 14 at a having a grease ripple 38, by inserting the axle 19 into the upper portion 14*b* and fastening with a nut 21.

The carrying member 14 includes a lower portion 14*a* for connecting to the hinge 16, and a spring seat 14*c* for positioning a spring 24 slanted to the upper portion 14*b*. An elongated hole 14*d* is formed at a lower portion of the carrying member for guiding a stopping rod 26.

Furthermore, three spring supports 20 and 23 are mounted on the frame 10, corresponding to the guide rollers 54*a*, 54*b* and 54*c*. Two spring supports 23 are opposite side faces 52*b* and 52*c* of the rail 52, respectively, for supporting the corresponding guide rollers 54*b* and 54*c*. The spring 24 is slantedly mounted between a spring seat member 22 and the spring seat 14*c* of the carrying member 14.

The spring seat member 22 is provided with a nut 25 to regulate the elastic force of the spring 24, for easy mounting of the spring 24. Preferably, the spring 24 and seat member 22 are positioned slanted with respect to the carrying member 14.

A stopping rod 26 is mounted on a second slanted surface 23*b* of the spring supports 23 by means of a nut 27, and has a stopper 28 fastened thereto by a lock nut 29. An end portion of the stopping rod 26 is extended through an elongated hole 14*d* of the carrying member 14 to limit a pivotal movement of the guide roller 54*a*.

The spring support 20 supporting the guide roller 54*a* which makes contact with the front surface 52*a* of the rail 52 includes a spring seat member 22 and a stopping rod 26, which are fastened to a vertical plane 20*a* by means of nuts 25 and 27, and a spring 24 is provided between the spring seat member 22 and the seat 14*c* of the carrying member 14.

The carrying member 14 is vertically connected to the axle 19 of the guide roller 54*a* because the carrying member 14 should be vertically mounted on a small area 10*b* of the frame 10 limited by a buffer (not shown) provided at the bottom of the hoistway.

Figure 8:
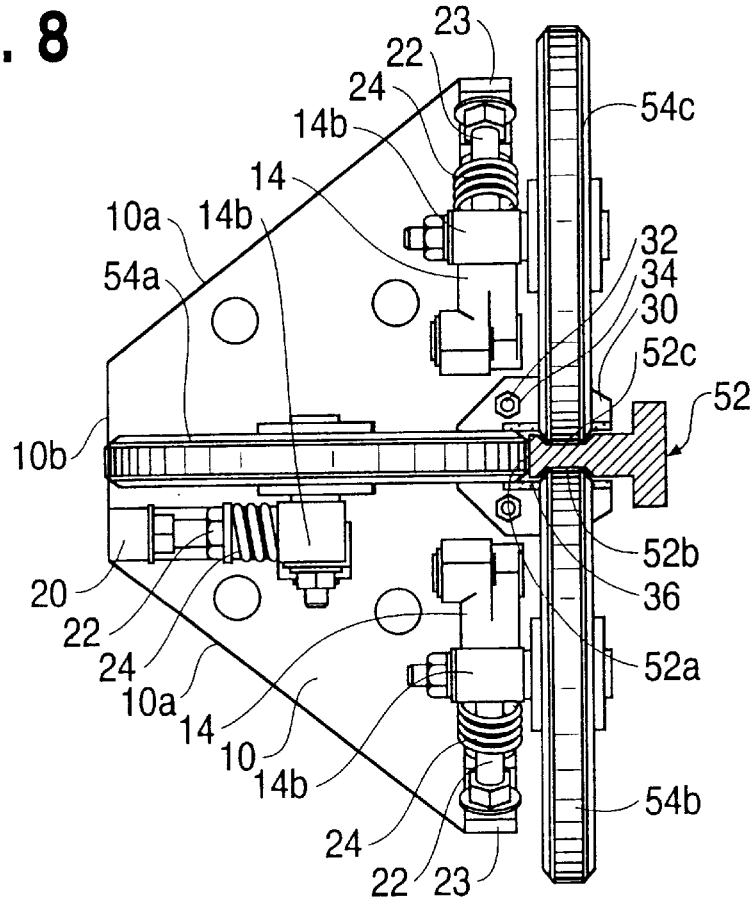
FIG. 8 is a plan view of FIG. 7.
Figure 9:
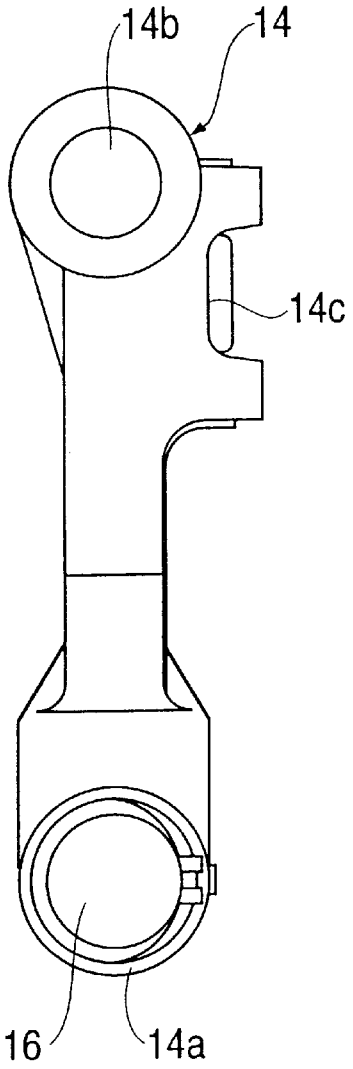
FIG. 9 is a front elevational view of a carrying member according to the invention.
Figure 10:
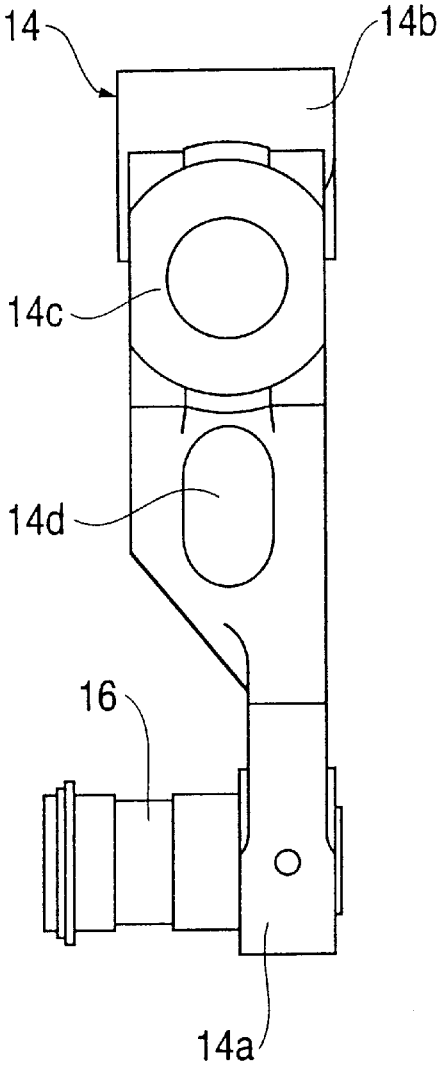
FIG. 10 is a side elevational view of FIG. 9.

Preferably, the carrying member 14 is connected to the axle 19 of the roller 54*a* at a right angle to be vertical and to be perpendicular to the frame 10 so that the carrying member 14 may be mounted on the small area 10*b* shown in FIG. 8 to avoid interfering with the buffer. However, this invention is not limited to the vertical structure of the carrying member 14 in this embodiment.

Figure 7:
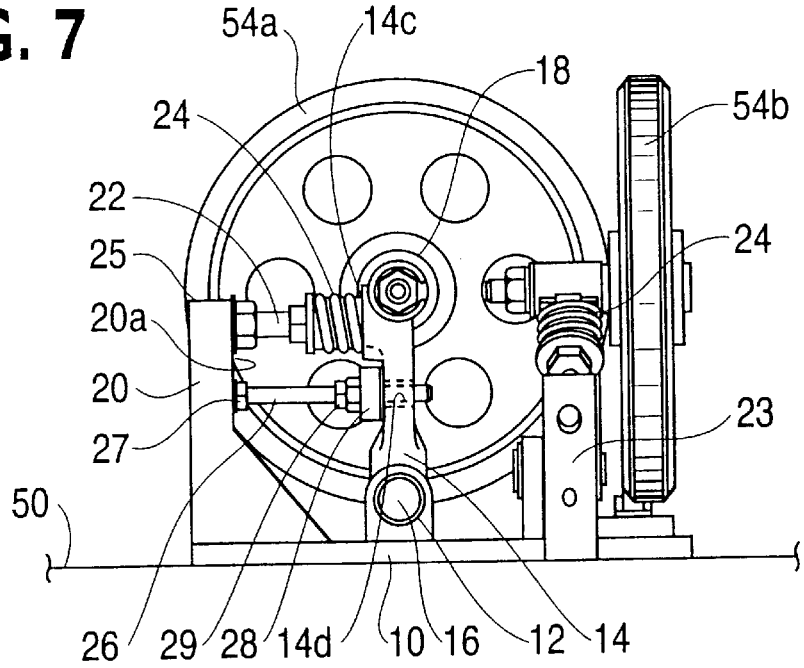
FIG. 7 is a front elevational view of FIG. 6.

The stopping rod 26 in FIG. 7 is provided with the stopper 28 fastened by the nut 29, and has an end portion thereof extended through the elongated hole 14*d* to limit the movement of the guide roller 54*a*.

When the elevator car moves up and down, the guide rollers 54*a*, 54*b* and 54*c* contacting the corresponding surfaces of the rail are subjected to a lateral force caused by a displacement and misalignment of the rail, and are pivoted at the hinge. The external lateral force may be divided into vertical and lateral forces, and the lateral force is absorbed by the springs 24 while the vertical force supports the carrying member 14. The vertical force does not affect the shaking of the elevator car because the inertia of the elevator car in a vertical direction (Y) is greater than that in a lateral direction (X). This can be further understood by the following explanation.

Figure 11:
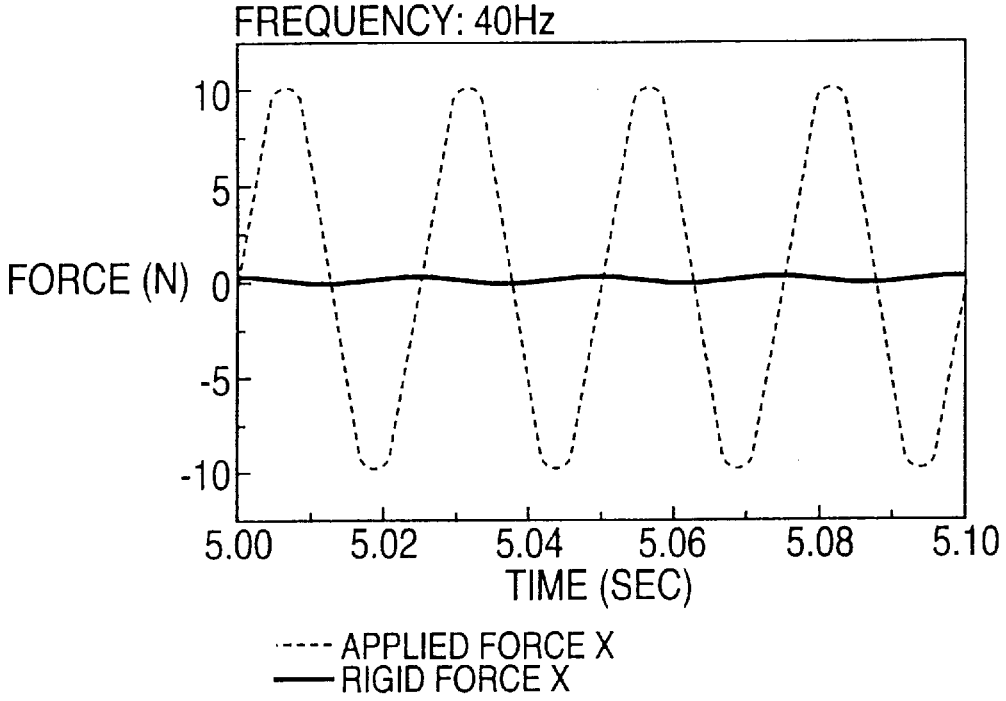
FIG. 11 (PRIOR ART)
FIG. 11 is a graph showing a lateral force acting on a spring mechanism compared with an external force in a conventional elevator car.
Figure 11:
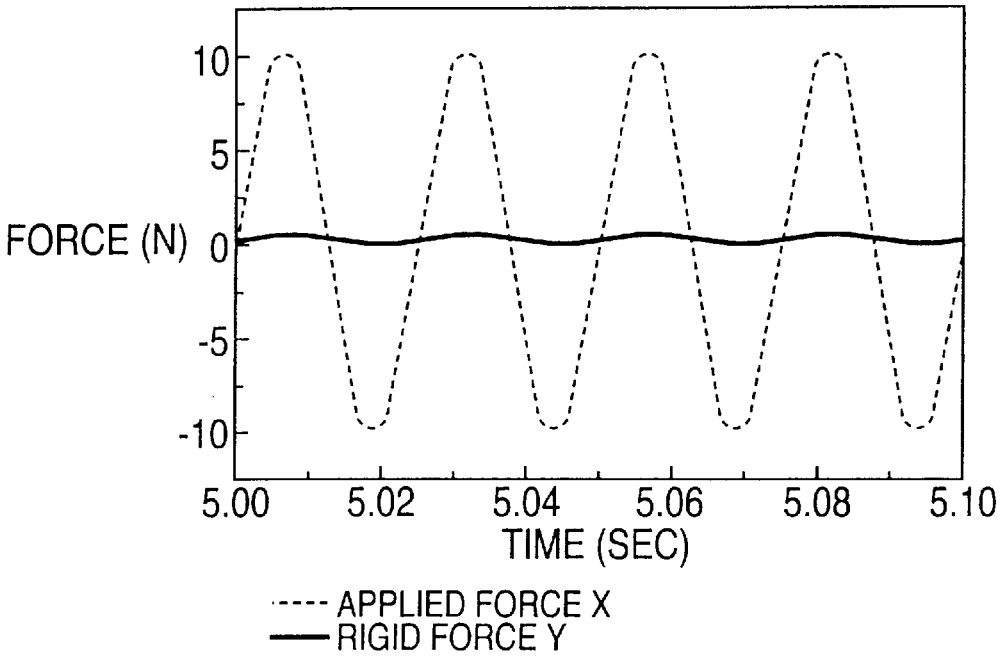
FIG. 11 (PRIOR ART)
Figure 12:
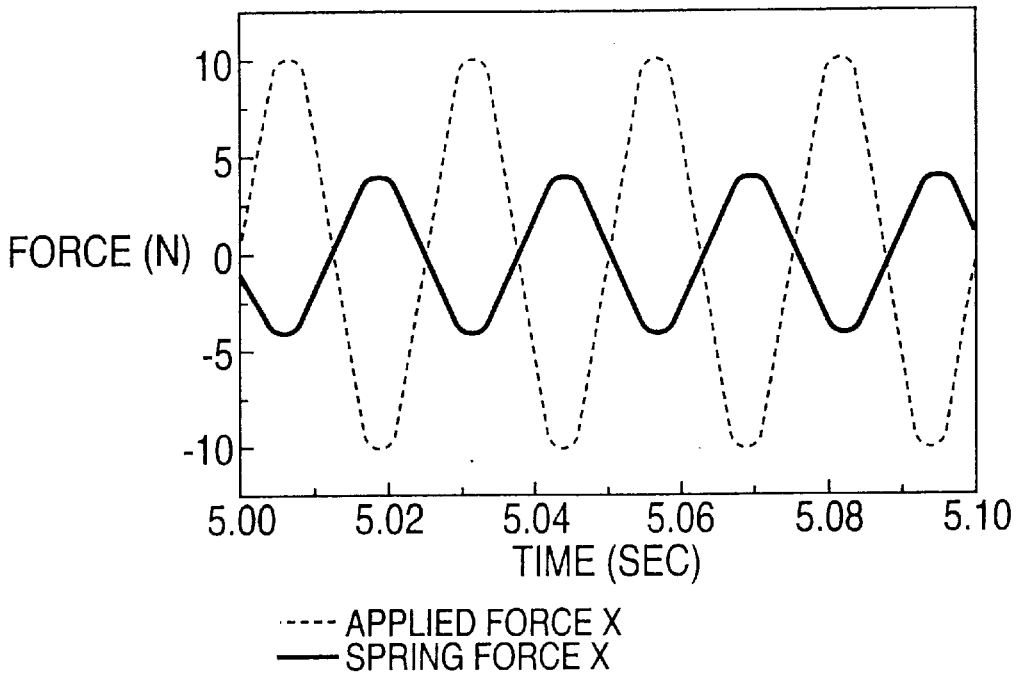
FIG. 12 (PRIOR ART)
FIG. 12 is a graph showing a lateral force acting on a carrying member compared with an external lateral force in a conventional elevator car.
Figure 12:
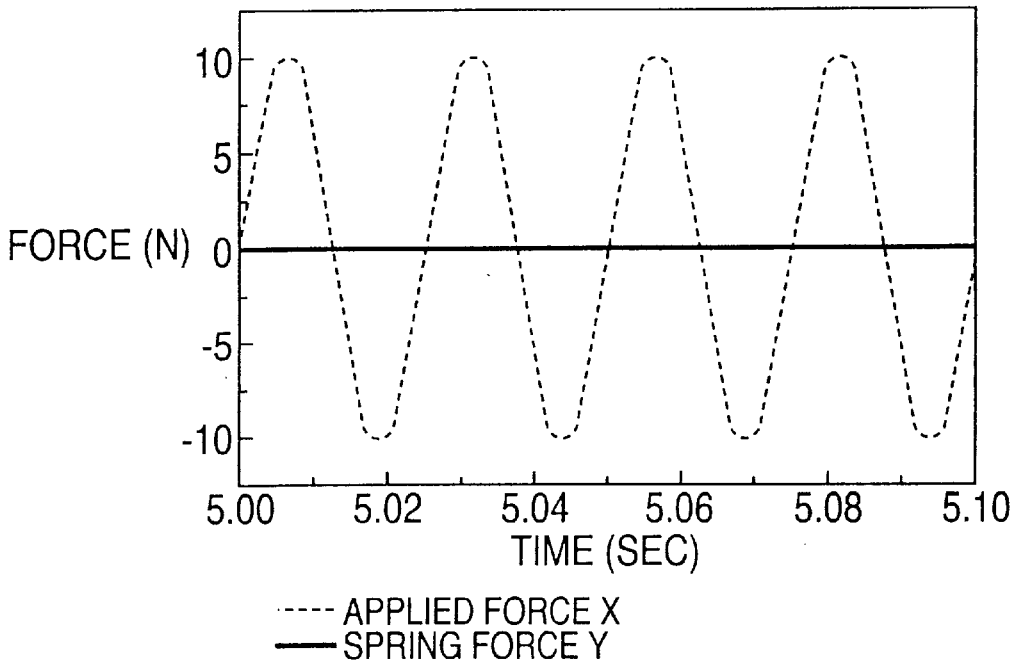
FIG. 12 (PRIOR ART)

Referring to FIGS. 11 and 12, when an external force of 10N is applied to the prior art guide roller in a 0.025 second period, almost no force in the X and Y directions is acted on the carrying member(see FIG. 11), while on the spring, about 5.0N is acted in the X direction and no force is acted in the Y direction.

Figure 13:
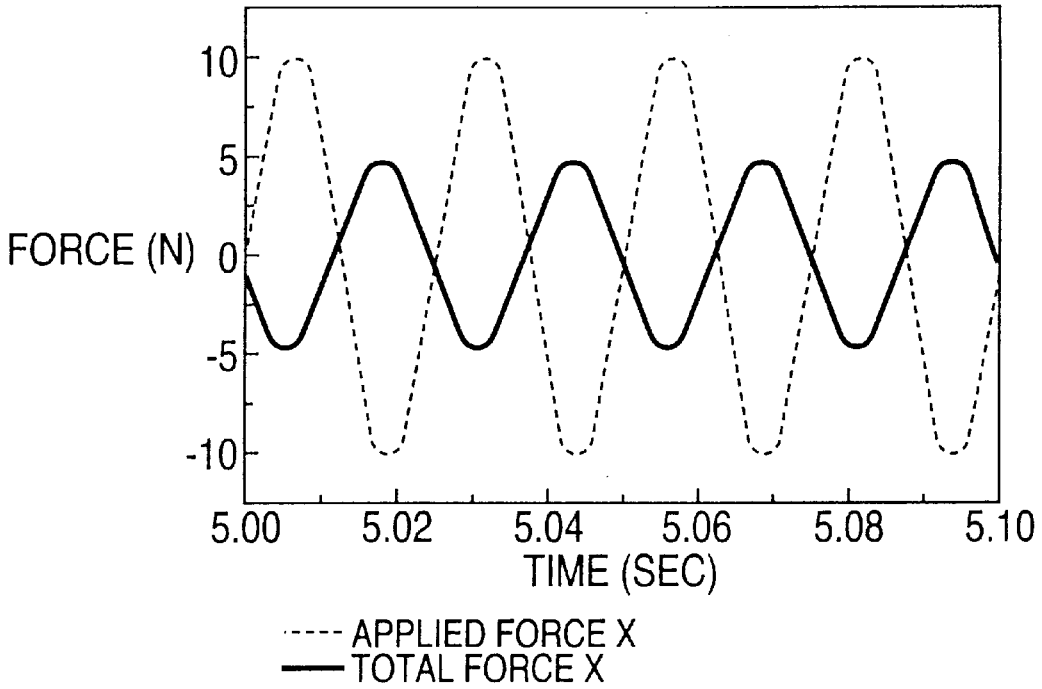
FIG. 13 (PRIOR ART)
FIG. 13 is a composite graph showing a resultant lateral force acting on the spring mechanism and the carrying member compared with an external lateral force in a conventional elevator car.
Figure 13:
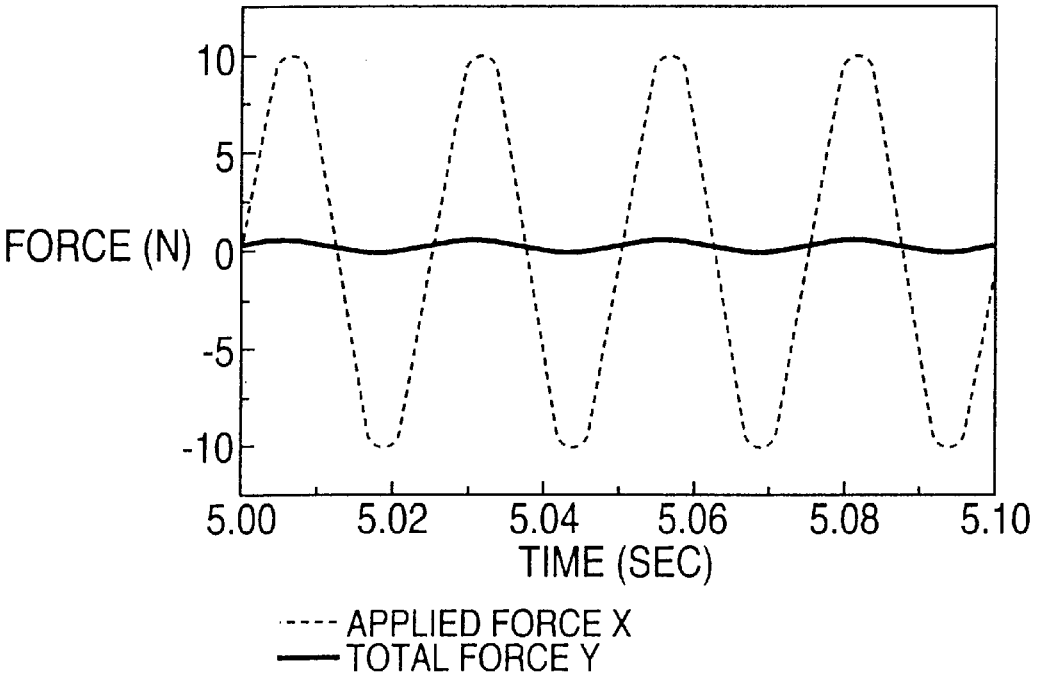
FIG. 13 (PRIOR ART)

As shown in FIG. 13, 5.0N is acted on the carrying member and spring in the X direction and no force is acted in the Y direction. Accordingly, in the prior art, the lateral external force acted on the guide roller produces the shaking of the elevator car.

Figure 14:
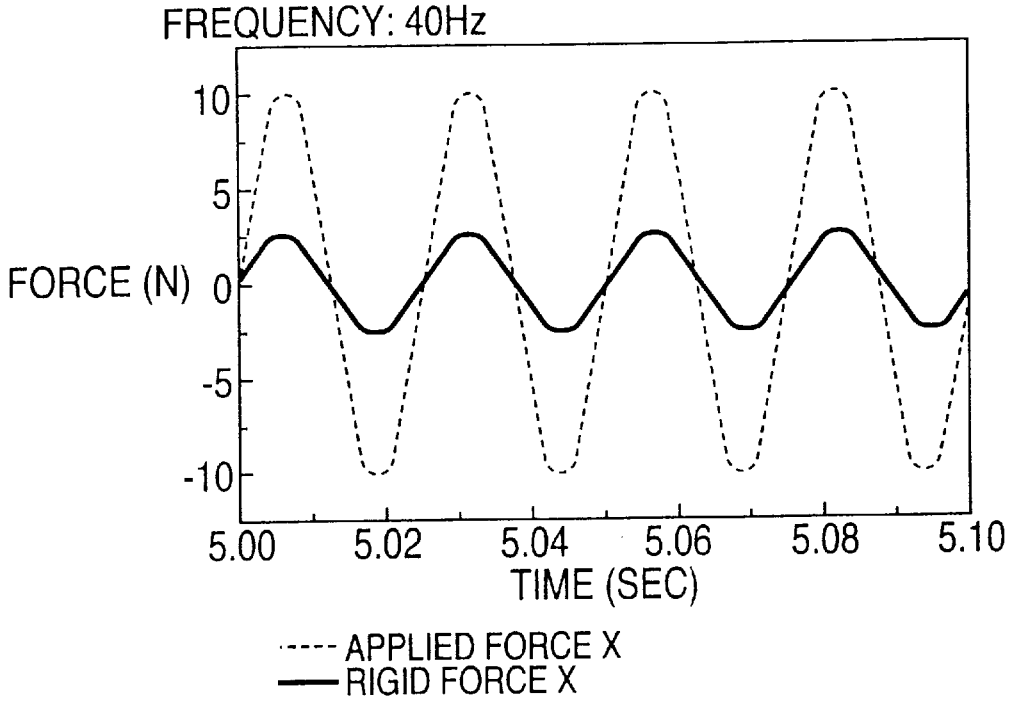
FIG. 14 is a graph showing a lateral force acting on the spring mechanism compared with an external force in this invention.
Figure 14:
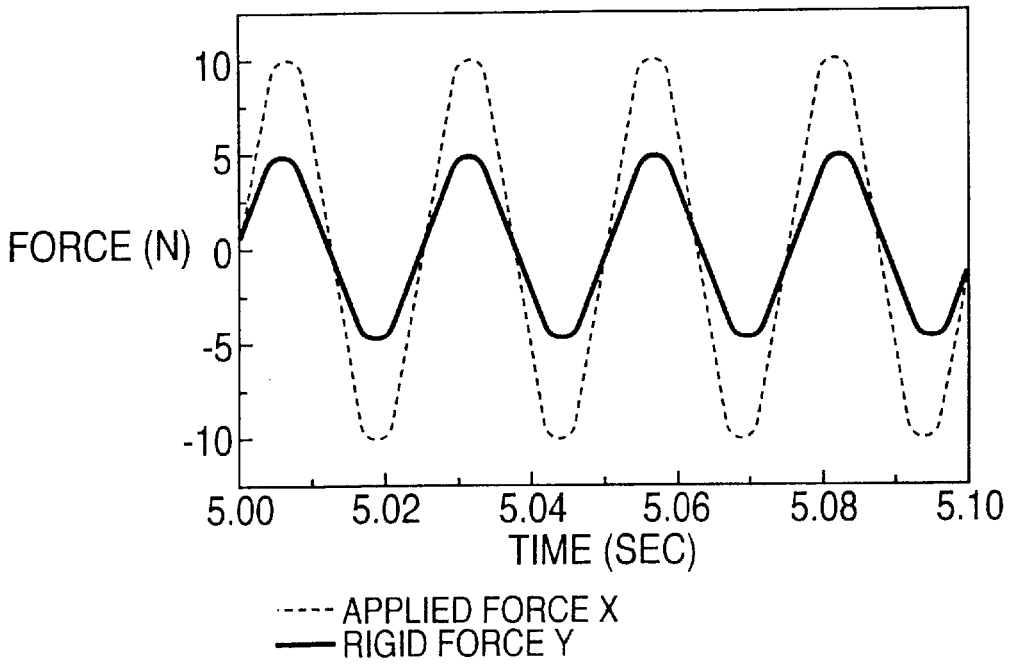
Figure 15:
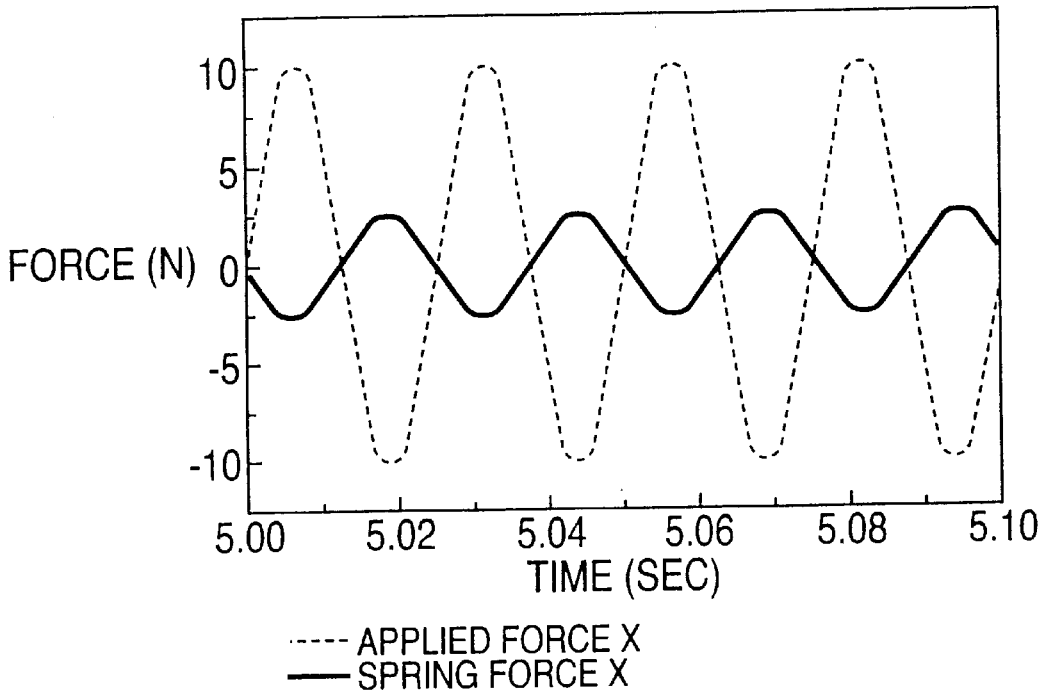
FIG. 15 is a graph showing a lateral force acting on a carrying member compared with an external lateral force in this invention.
Figure 15:
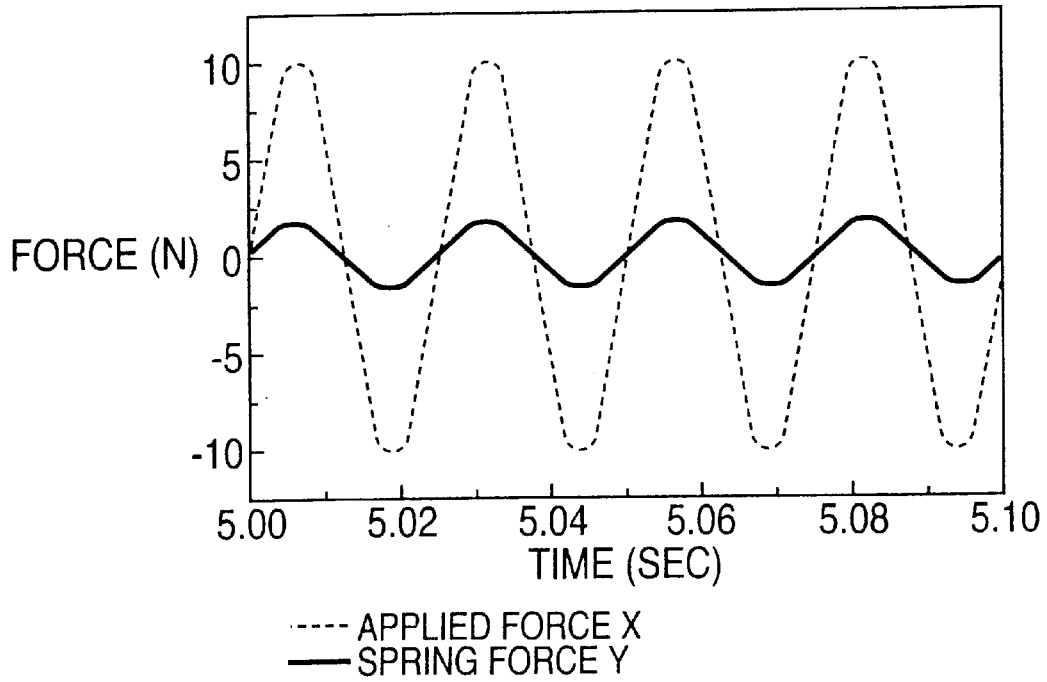

Referring to FIGS. 14 and 15, when the external force of 10N is applied to the inventive guide roller in a 0.025 second period, the forces of 2.5N in the X direction and 4.5N in the Y direction are acted on the carrying member(FIG. 14), while the forces of 2.5N in the X direction and 1.5N in the Y direction are acted on the spring(FIG. 15).

Figure 16:
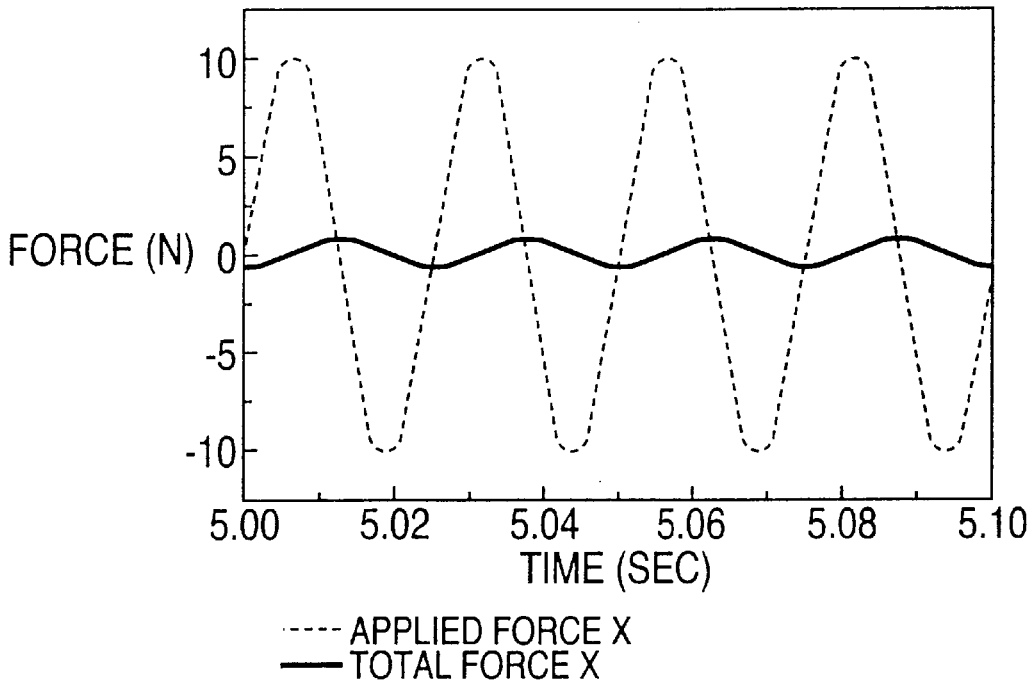
FIG. 16 is a composite graph showing a resultant lateral force acting on the spring mechanism and the carrying member compared with an external lateral force in this invention.
Figure 16:
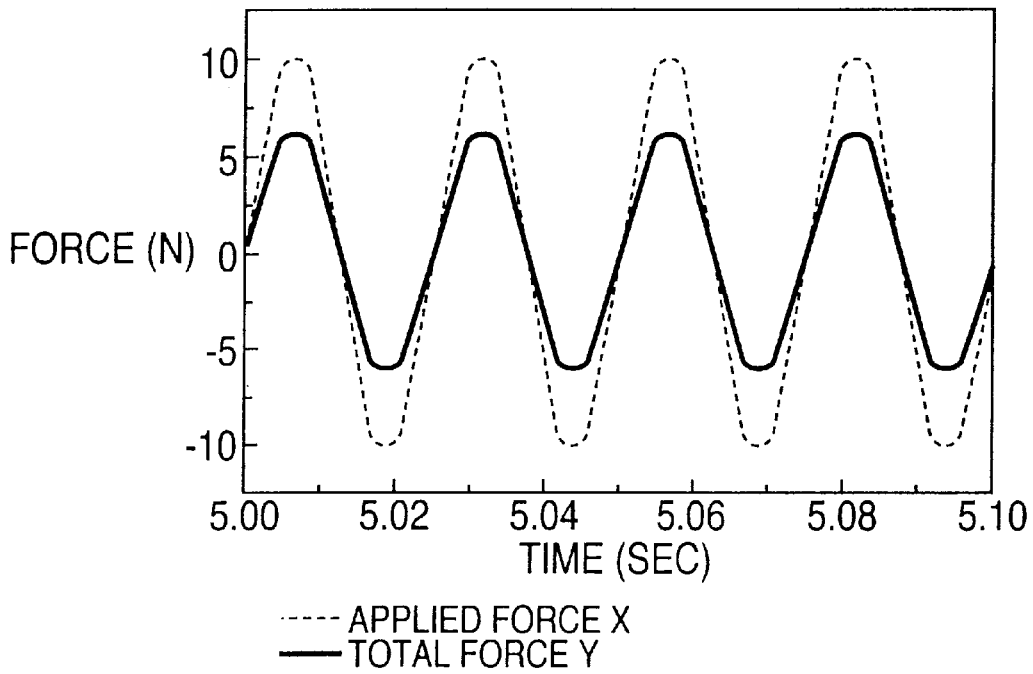

As shown in FIG. 16, the resulting composite force in the lateral direction is insignificant and the composite force in the vertical direction is about 6.0N.

In accordance with the invention, an external force acted on the guide rollers 54*a*, 54*b* and 54*c* during the up and down movement of the elevator car is divided into the vertical (Y) and lateral (X) directions, and the divided lateral force is almost completely absorbed by the spring to decrease the shaking of the elevator car.

In accordance with the invention, an excessive pivoting of the carrying member 14 with respect to a guide roller is limited by the stopper 28 to prevent the guide roller from derailing, and the frame stopper 30 is provided for preventing the frame from colliding with the guide rail. Furthermore, the respective spring supports 23 formed at an angle of about 60 degrees with respect to the spring 24 securely supports the forces transferred from the guide rollers 54*b* and 54*c* to the corresponding carrying member 14. Therefore, the stability of the guide roller supporting apparatus is obtained.

What is claimed is:

1. A guide roller apparatus for an elevator car frame which is accommodated to support guide rollers to guide movement of the elevator car along a guide rail vertically positioned with respect to an elevator passage and to make contact with front and side surfaces of the guide rail, comprising:

carrying members corresponding to the guide rollers, each carrying member having an end connected with a rotational axle of a respective guide roller and another end secured to a bottom frame of the guide roller apparatus; and plural spring means, each connected to a respective carrying member, for resiliently urging the respective carrying member to support the respective guide roller against the guide rail, the bottom frame is securely provided with brackets for hinge-connection with the respective carrying members and spring supports for supporting one end of the respective spring means, first and second spring means corresponding to the respective guide rollers making contact with the side surfaces of the guide rail being slanted with respect to the bottom frame and the spring supports of the first and second spring means having a slanted surface for slantedly positioning the spring means with respect to the bottom frame.

2. The guide roller supporting apparatus according to claim 1, wherein a grease nipple for lubrication is provided for each bracket.

3. The guide roller supporting apparatus according to claim 1, wherein each of the carrying members is connected to the respective spring means at a right angle.

4. The guide roller supporting apparatus according to claim 1, wherein each spring means includes a spring and a spring seat.

5. The guide roller supporting apparatus according to claim 1, wherein the carrying members of the respective guide rollers making contact with the side surfaces of the guide rail are slanted with respect to the bottom frame.

6. The guide roller supporting apparatus according to claim 5, wherein the slanted carrying members are slanted at an angle less than 90 degrees.

7. The guide roller supporting apparatus according to claim 5, wherein a slanting angle of the slanted carrying members is in a range between 0 and 90 degrees.

8. The guide roller supporting apparatus according to claim 5, the carrying member of the respective guide roller making contact with the front surface of the guide rail is perpendicular with respect to the bottom frame.

9. The guide roller supporting apparatus according to claim 1, wherein the spring means corresponding to the respective guide roller making contact with the front surface of the guide rail being positional parallel with respect to the bottom frame.

10. A guide roller supporting apparatus for an elevator car frame which is accommodated to support guide rollers to guide movement of the elevator car along a guide rail vertically positioned with respect to an elevator passage and to make contact with front and side surfaces of the guide rail, comprising:

carrying members corresponding to the guide rollers, each carrying member having an end connected with a rotational axle of a respective guide roller and another end secured to a bottom frame of the guide roller supporting apparatus; and plural spring means each connected to a respective carrying member, for resiliently urging the respective carrying member to support the respective guide roller against the guide rail, the bottom frame is securely provided with brackets for hinge-connection with the respective carrying members and spring supports for supporting one end of the respective spring means, a stopper rod is provided between each respective spring support and respective carrying member to prevent the guide rollers from derailing.

11. The guide roller supporting apparatus according to claim 10, wherein the stopping rods of guide rollers making contact with side surfaces of the guide rail are slanted with respect to the bottom frame.

12. The guide roller supporting apparatus according to claim 10, wherein the respective carrying members each comprise:

a first end portion and a second end portion, the second end portion is hinged to the rotational axle of a respective guide roller and positioned along a same axis as the first end portion, the first end portion being connected with the bottom frame, the second end portion being opposite to the first end portion;

a spring seat being at a right angle with respect to the second end portion for positioning the respective spring means; and an elongated hole formed at a lower portion for guiding the respective stopper rod.

13. The guide roller supporting apparatus according to claim 12, wherein the respective carrying members are integrated with the bottom frame.

14. A guide roller supporting apparatus for an elevator car having guide rollers which make contact with front and side surfaces of a guide rail, comprising:

plural carriers, each having a first end connected to an axle of a respective guide roller and an opposite second end secured to a bottom frame of the guide roller supporting apparatus, for supporting the guide rollers; and plural springs each resiliently urging a respective carrier to support the respective guide roller against the guide rail, the spring corresponding to the guide roller making contact with the front surface of the guide rail being parallel to the bottom frame and the other springs corresponding to the guide rollers making contact with the side surfaces of the guide rail being slanted with respect to the bottom frame.

15. The guide roller supporting apparatus according to claim 14, wherein the carrier corresponding to the guide roller making contact with the front surface of the guide rail is positioned perpendicular to the bottom frame.

16. The guide roller supporting apparatus according to claim 15, wherein the carriers corresponding to the guide rollers making contact with the side surfaces of the guide rail are slanted with respect to the bottom frame.

17. The guide roller supporting apparatus according to claim 16, wherein the slanted plural carriers are slanted at an angle less than 90 degrees.

18. The guide roller supporting apparatus according to claim 14, wherein an external force acting on the guide rollers during traveling of the elevator car along the guide rail is divided into vertical and lateral directional forces, the lateral directional force being substantially completely absorbed by the plural springs.

* * * * *